United States Patent [19]

Romer et al.

[11] 4,444,115

[45] Apr. 24, 1984

[54] CARTRIDGE-TYPE MUNITION HAVING A DESTRUCTIBLE OR PARTIALLY COMBUSTIBLE CASING

[75] Inventors: Rudolf Romer; Jürgen Winkelmann; Horst Sabinski, all of Karst, Fed. Rep. of Germany

[73] Assignee: Rheinmetall GmbH, Düsseldorf, Fed. Rep. of Germany

[21] Appl. No.: 54,152

[22] Filed: Jun. 25, 1979

[30] Foreign Application Priority Data

Jun. 28, 1978 [DE] Fed. Rep. of Germany ..... 2828251

[51] Int. Cl.[3] ..... F42B 5/16

[52] U.S. Cl. ..... 102/431; 102/430; 102/443; 102/523

[58] Field of Search ..... 102/430, 431, 432, 433, 102/443, 464, 465, 466, 520–523, 703, 444

[56] References Cited

U.S. PATENT DOCUMENTS

| | | | |
|---|---|---|---|
| 562,535 | 6/1896 | Hurst | 102/443 |
| 2,971,426 | 2/1961 | Potts | 102/430 X |
| 3,009,394 | 11/1961 | Kamp et al. | 102/434 X |
| 3,288,066 | 11/1966 | Stadler et al. | 102/430 |
| 3,342,134 | 9/1967 | Stadler et al. | 102/444 |
| 3,901,153 | 8/1975 | Brabets et al. | 102/700 |
| 3,978,792 | 9/1976 | Campole et al. | 102/38 |
| 3,981,246 | 9/1976 | Luther et al. | 102/93 |
| 4,000,697 | 1/1977 | Levine | 102/433 |
| 4,015,527 | 4/1977 | Evans | 102/38 |

*Primary Examiner*—Harold J. Tudor

*Attorney, Agent, or Firm*—Karl F. Ross; Herbert Dubno

[57] ABSTRACT

A cartridge-type munition comprising a casing and a projectile in which the casing at least in part is constituted of combustible and destructible material. According to the invention, a first connection between the projectile and the casing is formed by a neck engaging the periphery of the projectile which is also formed with a boss or projection at its rear end engaged by radial elements forming a second connection with the casing axially spaced from the first connection.

16 Claims, 12 Drawing Figures

CARTRIDGE-TYPE MUNITION HAVING A DESTRUCTIBLE OR PARTIALLY COMBUSTIBLE CASING

FIELD OF THE INVENTION

The present invention relates to a munition round or ammunition for a barrel-type weapon which comprises a projectile and a destructible or partially destructible (combustible or partially combustible) casing or shell.

BACKGROUND OF THE INVENTION

A shell-type munitions round (ammunition) for a barrel-type weapon, e.g. a cannon, can comprise a projectile constituting the warhead and a shell or casing which is composed at least in part of combustible or destructible material. The latter shell or casing is at least in part destroyed upon the firing of the round as is described, for example, in German Pat. DE-PS No. 1,453,842 and German Pat. Document (Open application) De-OS No. 2,323,244. The cartridge-type munition round described in German Pat. No. 1,453,842 and in the corresponding German printed application (Auslegeschrift) DE-AS No. 1453842 has a projectile or warhead of conventional type and a shell or casing which is constricted into a neck peripherally engaging the cylindrical body of this projectile or warhead.

In the German Open Application No. 2,323,244, the projectile is a subcaliber fin-stabilized projectile whose drive cage is connected with a combustible shell by a frustoconical transition or connecting piece. The connecting piece and the shell can be attached to one another by adhesive and can be constituted, like the casing, of combustible material.

Since combustible or, more generally, destructible casings have a significantly reduced strength compared to metallic casings, the connecting point between the projectile and the casing is the weakest point of the cartridge-type munition round. At this point the relatively heavy projectile must be bonded to the shell in such fashion as to enable the round to be capable of withstanding shock, vibration, bending, tensile and pressure stresses. This enables the cartridge-type munition round to withstand handling, insertion into the weapon and the initial firing operations.

Failure of this bond or, more generally, failure of the connection between the combustible casing and the projectile renders the munitions round operationally unreliable.

For example, when the stress upon the casing exceeds the permissible stress, the munition round can be so distorted that it cannot be inserted into the magazine of the weapon or causes the round to jam in the magazine.

Since, moreover, it is not always possible to detect rapidly whether the munition round has been damaged or distorted, problems in firing or handling such rounds have been encountered.

One of the difficulties in overcoming this problem is that it is almost impossible or impractical to change the basic shape of the munition round from the standard shapes if the munition round is to be accommodated into the magazines of existing weapons or to be a standard round for firing from a number of standardized weapons.

To date, to our knowledge, the problem has not been solved by conventional means.

OBJECTS OF THE INVENTION

It is, therefore, the principal object of the present invention to provide a munition round for firing from conventional barrel-type weapons in which the aforementioned disadvantages are obviated.

It is another object of the invention to provide an improved munition round whose connection between the combustible or destructible casing and the projectile is capable of withstanding stresses in all directions and of all types without risking distortion of the round or damage thereto such that jamming of the round in the magazine of the weapon may occur.

Still another object of the invention is to provide an improved munition round which is highly stable, resistant to bending stresses and capable of withstanding handling, loading and firing operations in practically the same manner as metal-casing rounds in spite of the fact that the strength of the casing material is significantly less than that of metallic casings.

A further object of the invention is to provide a munition round with a combustible or destructible casing in which the connection between the casing and the projectile is capable of withstanding significant mechanical stress in spite of poor strength characteristics of the casing material.

SUMMARY OF THE INVENTION

These objects and others which will become apparent hereinafter are attained, in accordance with the present invention, in a cartridge-type munition of conventional outer configuration which has an at least partially combustible or destructible casing connected to a projectile or warhead.

According to the invention, the connection between the projectile and the casing is constituted by two axially spaced connecting regions in which the projectile is peripherally engaged by the combustible or partially combustible material of the casing.

More particularly, a first connection is provided between a body portion of the projectile and the casing at the usual neck or constriction of the casing formed at the forward end thereof, thereby providing a first peripheral bond between the casing and the projectile.

According to the invention, moreover, the projectile is formed with a projection of boss extending axially from its rearward end into the interior of the casing, this projection being engaged by radial support elements forming a second connection to the projectile axially spaced from the first connection.

According to a feature of the invention, the radial support element is a flexible conical web terminating in a cylindrical apron peripherally surrounding and receiving the projection or boss and the rearward end of the projectile. This frustoconical member can be formed with throughgoing openings communicating between a portion of the propellant-containing chamber rearwardly of the projectile and a second chamber between the first and second connections. The frustoconical member may have the configuration generally of a frustoconical disk.

The propellant can, of course, be a solid combustible propellant or powder which can be fired by a primer or the like as in conventional cartridge-type shells.

The cartridge-type munition round of the present invention can also be provided with support elements in angularly equispaced relationship disposed between the inner wall of the casing and the outer periphery of, for example, the tail-fin assembly which in this case constitutes a rearward projection of the projectile.

The support element may be a circular member having cylindrical portions engaging the inner wall of the casing and the tail-fin assembly, these cylindrical portions being connected by a web lying in a plane perpendicular to the axis of the cartridge and provided with throughgoing openings connecting, for example, a primer chamber or a propellant chamber behind the tail-fin assembly with a chamber ahead of the support element.

According to yet another feature of the invention, the support element or elements may be composed at least in part of combustible material, e.g. of the same type of material as the shell, the support element being destroyed upon the firing of the shell at least in part.

According to still another feature of the invention, the support element can be formed at least in part of a pulverulent material or be a body shaped from pulverulent material.

In all of the cases previously described, the support element can be formed with weakened zones designed to break away upon firing of the munitions round.

As has been indicated previously, the projectile or the warhead can be formed with or without a tail-fin assembly, i.e. can be spin-stabilized or fin-stabilized.

When the projectile is a fin-stabilized projectile, it can be provided with a tail-fin assembly having three (or more) radially extending fins in angularly equispaced relationship. In this case, the support element can comprise a corresponding number of radially outwardly extending support members which can engage the fins or bear thereon.

Alternatively, the support element can comprise a number of angularly equispaced radially extending supports reaching to the hub of the tail-fin assembly.

According to a further feature of the invention, the supports may have a generally H shape and can reach towards the tail-fin members while being provided with recesses accommodating these members, the recesses extending in the axial direction.

According to yet another feature of the invention, the support member is a disk lying in a plane perpendicular to the axis of the projectile and the round and having a U-profile in an axial plane of the projectile. One apron (cylindrical) of the profile can engage the inner wall of the casing while the other apron can lie against the outer edges of the tail fins of the tail-fin assembly.

Alternatively or in addition, the apron of the disk lying against the tail-fin assembly can be bent radially inwardly to form an axial abutment for this assembly.

According to an additional feature of the invention, the radially inwardly lying portions of the disk may be formed with recesses accommodating the fins and of a corresponding cross section.

An important feature of the invention, in all of the embodiments described, is that the connection between the projectile and the casing no longer is effected at a single region along the length of the projectile, but rather is effected at two axially spaced locations at least one of which can be relatively far from the center of gravity of the projectile warhead. Especially when long projectiles are provided, the lever arm afforded by this connection remote from the center of gravity is extremely long and provides excellent stability against externally applied forces.

In all cases, the first connection can be provided at the usual neck of the casing at the forward end thereof while the second connection is provided at the a location axially removed therefrom and at the rear end of the projectile.

A firm connection and anchoring of the projectile in the casing is achieved in spite of the low mechanical strength of the casing material and the outer configuration of the cartridge or round can correspond to the conventional configuration.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
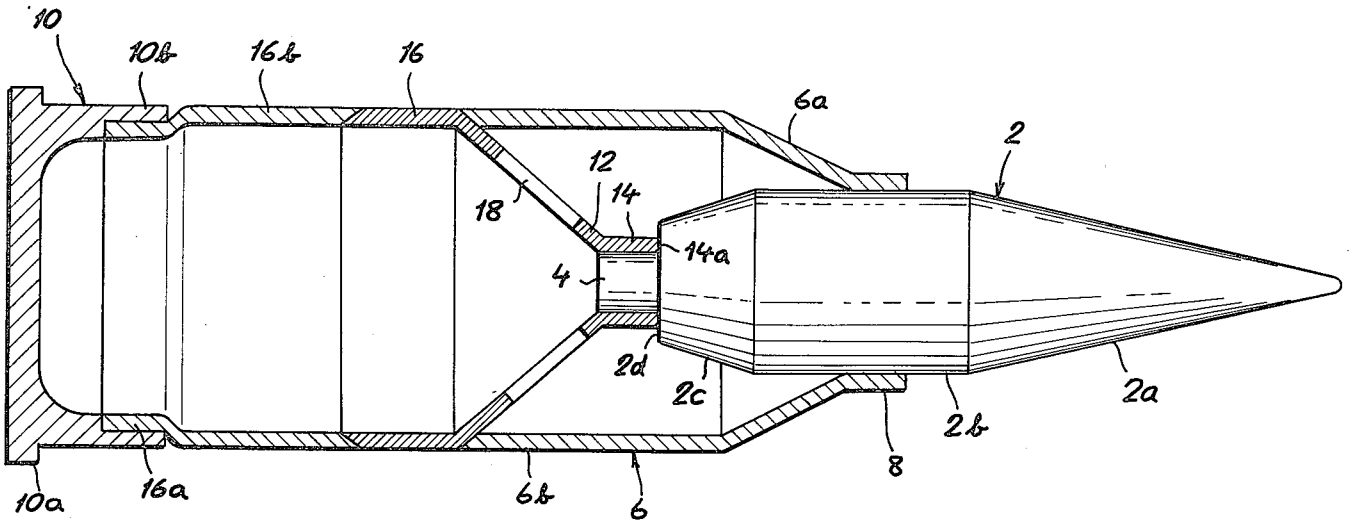
FIG. 1 is a schematic axial cross-sectional view through a first embodiment of a cartridge or round in accordance with the present invention.

FIG. 1 shows a cartridge-type munition round for a spin-stabilized projectile or warhead 2 having a frustoconical point **2*a* followed by a generally cylindrical body portion 2*b*, a frustoconically rearwardly converging portion 2*c* and a cylindrical extension, projection or boss 4**.

A combustible shell or casing 6 is formed with the usual frustoconically forwardly converging portion **6*a* terminating in a cylindrical neck 8** constituting the constriction of the casing.

The neck 8 is circumferentially anchored to the body **2*b*** of the projectile in the usual manner.

The rear end of the casing is formed with a stub 10 provided with the usual flange **10*a*** and carrying the primer of the cartridge or round (not shown) which fires the powder charge contained in the shell or casing and likewise not shown.

The cylindrical portion **10*b* of the stub is connected to a cylindrical portion 16*a* of a metallic portion 16*b* of the casing which has a frustoconical support disk 12** reaching inwardly and terminating in a cylindrical neck 14 engaging the projection 4. The projection is thus circumferentially engaged by the neck 14 at a location axially rearwardly of the center of gravity of the projectile 2 which can lie in the region of the body 2*b* engaged by the neck 8. The forward end 14*a* can abut the end face 2*d* of the projectile 2, i.e. the shoulder between the frustoconical portion 2*c* and the cylindrical boss 4, to form an axial stop for the projectile 2.

Openings 18 in the support element 12 provide a connection between the front and rear portions of the combustible sleeve 6 and can communicate between the two chambers of the latter which are filled with the charge powder. The support element 12 is composed of the same combustible material as the shell 6 and burns or is destroyed during the firing.

The frustoconical configuration of the disk 12 has been found to provide a special stability to the casing and the munitions round in spite of the relatively low mechanical strength of the combustible material so that the projectile 2 is firmly held by the neck 8 and the cylindrical portion 14 and is capable of withstanding significant mechanical stress.

Figure 2:
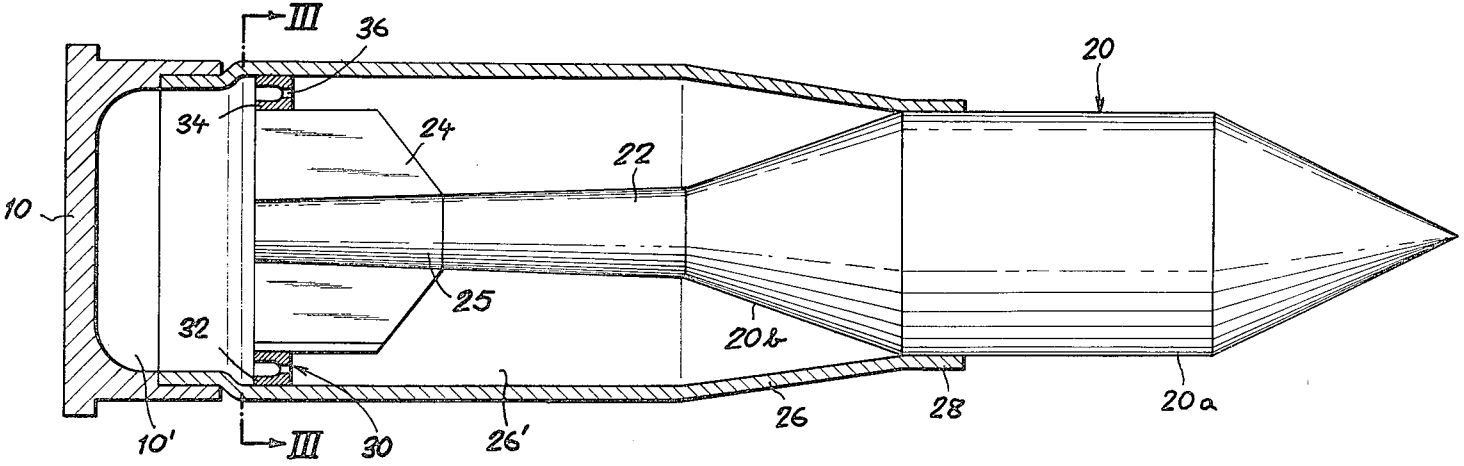
FIG. 2 is a schematic axial cross section through a second embodiment of a cartridge or round using a fin-stabilized projectile and adapted to be fired from a barrel-type weapon.
Figure 3:
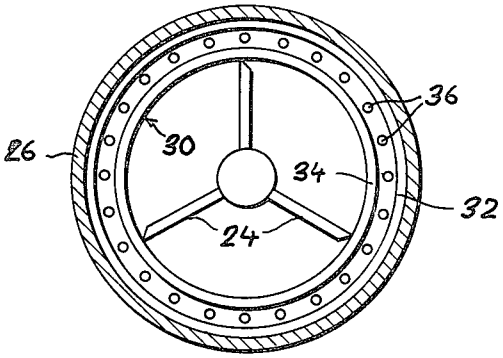
FIG. 3 is a cross section taken along the line III—III of FIG. 2.

In FIGS. 2 and 3 we have shown a cartridge-type munition round using a fin-stabilized projectile 20. The full-caliber body 20*a* of the projectile is engaged by the cylindrical neck 28 at the forward end of the frustoconical converging portion 26 of the casing which is composed of combustible material.

From the body 20*a*, the projectile has a frustoconically rearwardly converging portion 20*b* which is extended axially by the projection 22 at the end of which a tail-fin carrier or hub 25 is provided. The tail fins (here 3 annularly spaced tail fins) are represented at 24 and extend radially outwardly from the carrier 25.

The tailfin assembly is retained at a location rearwardly from the neck by a disk-shaped support element in the form of a ring 30 of U-profile in an axial plane of the round. The ring 30 thus has an outer apron or flange 32 which is cylindrical and is secured to the inner wall of the casing 26, e.g. by an adhesive or by friction, and an inner cylindrical flange 34 which bears upon the outer edges of the tail fins 24. The web between these flanges is provided with angularly equispaced bores 36 communicating between the primer and charge chamber 10′ in the stub 10 of the casing and the chamber 26′ containing the charge ahead of the ring 30.

Figure 4:
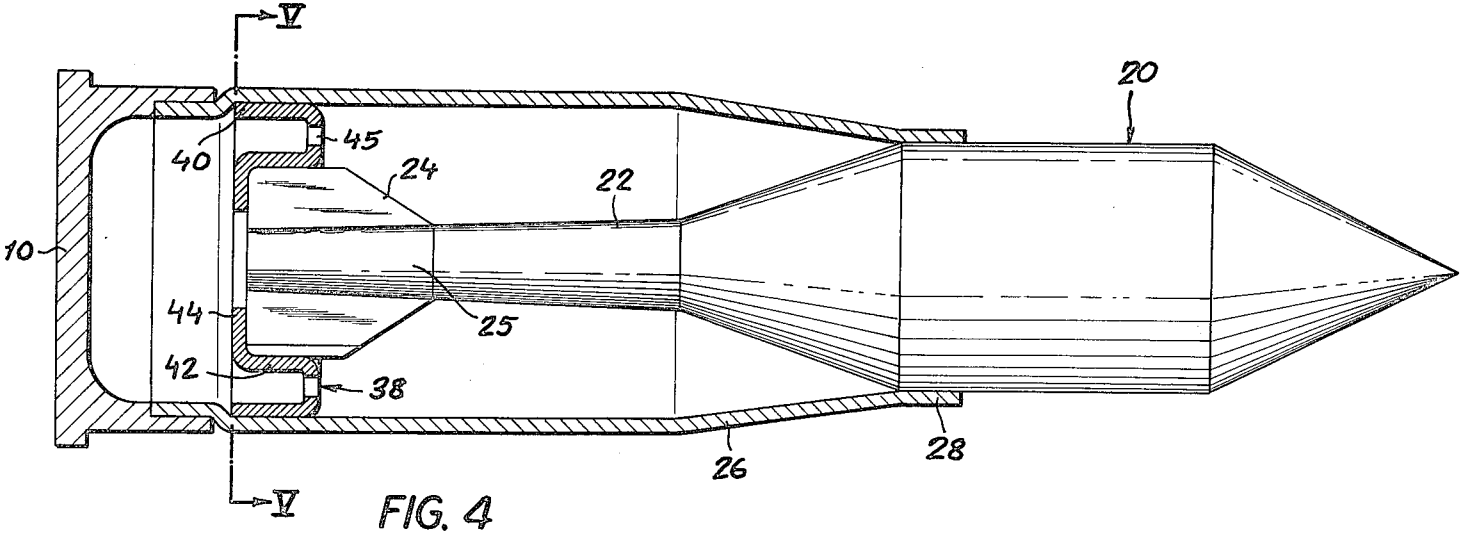
FIG. 4 is a schematic axial cross section through a munitions round generally corresponding to that of FIG. 2 but illustrating another embodiment of the support element.
Figure 5:
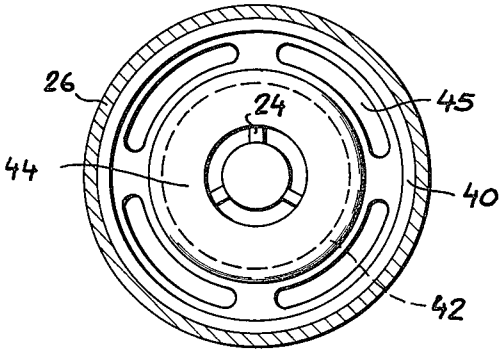
FIG. 5 is a cross-sectional view taken along the line V—V of FIG. 4.

Yet another embodiment of the cartridge-type munition round of the present invention is shown in FIGS. 4 and 5, the projectile being similar to that of FIGS. 2 and 3 and having a body 20 from which a rearward extension 22 projects into the interior of the combustible casing 26 whose cylindrical neck 28 engages the body 20 close to the center of gravity of the projectile.

The tailfin assembly 24, 25 at the rear end of the extension 22 is here engaged by a support element in the form of a ring 38 whose inner cylindrical apron 42 bears upon the outer edges of the tail fins 24 while inward radial flange 44 from this apron 42 forms an axial abutment for the projectile along the end thereof within the casing. The cylindrical apron 40 engages the inner wall of the combustible casing and likewise may be adhesively bonded thereto. The web of the ring 38, lying in a plane perpendicular to the axis of the round, can be formed with arcuate slots 45 communicating between the two chambers within the shell or casing.

Figure 6:
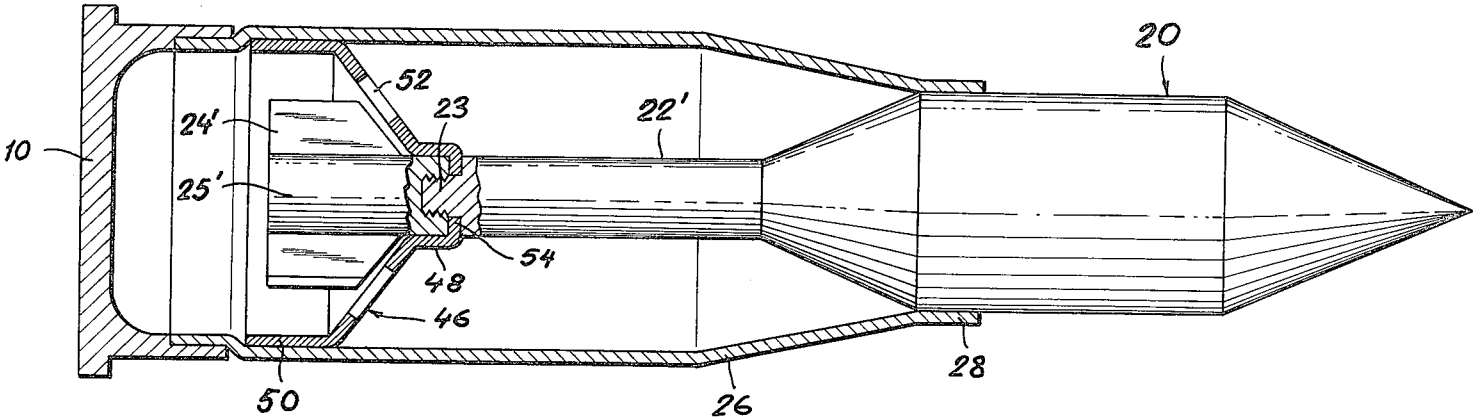
FIG. 6 is a schematic axial cross-sectional view through a similar munition round illustrating a third embodiment of the support element therefor.

A further variant of a cartridge-type munitions round has been illustrated in FIG. 6. Here again, the full-caliber projectile 20 has an extension 22′ terminating in a carrier 25 for the angularly equispaced tailfins 24′.

In this embodiment, however, the support element is a frustoconical ring 46 having a cylindrical apron 50 engaging the inner wall of the casing 26 and converging toward the projectile. A cylindrical neck 48 of the ring 46 closely surrounds and hugs the support 25′ which can be connected by a screw thread 23 with the extension 22′.

An inwardly extending circular flange 54 can be clamped between the carrier 25′ and the extension 22′ to form an axial abutment or stop preventing movement of the projectile within the shell or casing. In this case as well the ring 46 is composed of combustible material. Openings 52 are provided in the frustoconical walls of the ring 46 to communicate between the two compartments of the casing.

Figure 7:
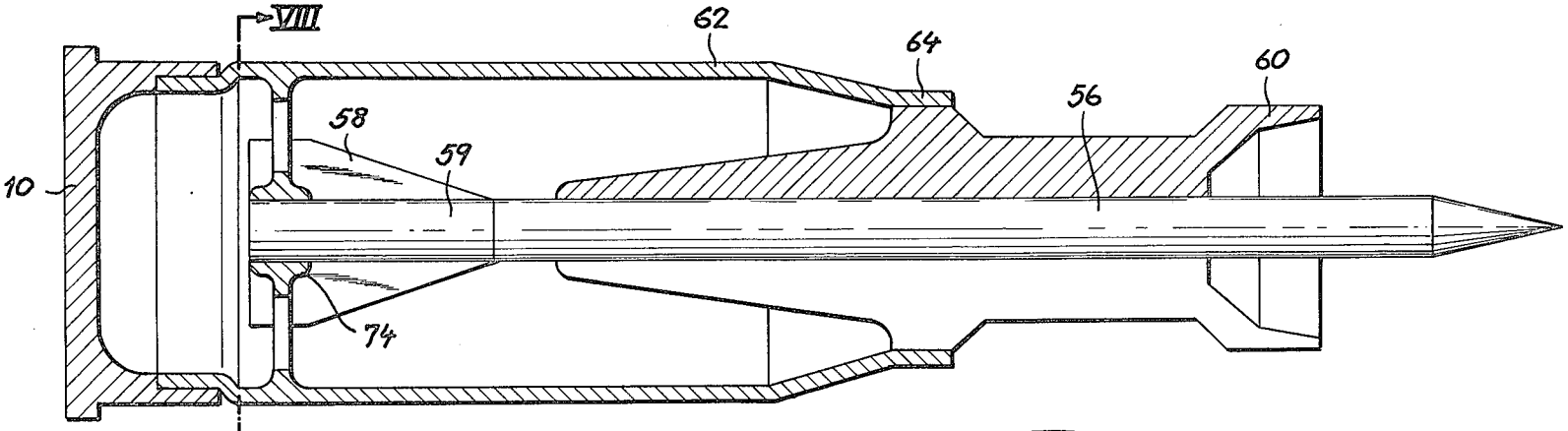
FIG. 7 is still another axial cross-sectional view of a cartridge-type munition round in accordance with the invention.
Figure 8:
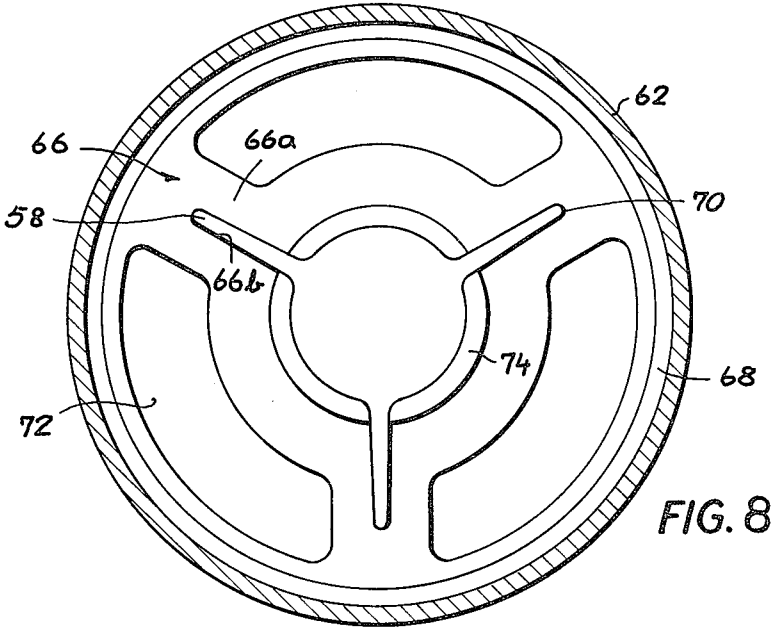
FIG. 8 is a cross-sectional view taken along the line VIII—VIII of FIG. 7.

In the embodiment of FIGS. 7 and 8, we have shown a fin-stabilized, sub-caliber projectile 56 which carries a drive cage 60 which may be held in place by rupturable bands (not shown) of conventional design and which may break away from the projectile 56 when the latter is in flight. For the purposes of this invention, therefore, the drive cage 60 and the projectile 56 proper form the projectile unit of which member 56 is the warhead.

The rear end of the warhead 56 extends rearwardly of the projectile 56, 60 and is formed with a carrier 59 for the tailfins 58.

The warhead 56 has a relatively small diameter and is proportionately very long while the drive cage 60 is of larger diameter and is dimensioned to correspond to the internal diameter of the barrel of the weapon from which the projectile is to be fired.

The drive cage 60 is here engaged by the cylindrical neck 64 of the combustible casing 62 which has an inwardly extending disk-shaped support element 66 provided with throughgoing openings 72 communicating between the two chambers. The webs 66*a* between the openings 72 can be slotted at 66*b* to accommodate the tailfins 58 while internal flanges 74 between the fins 58 snugly engage or hug the cylindrical portion of the carrier 59.

The disk 66 can be integral with the wall of the casing 62 as shown in FIG. 7 or can be provided with a cylindrical apron as represented at 68 which frictionally abuts the inner wall of the casing 62.

In the embodiment of FIG. 7, the disk 66 is composed of the same material as the casing 62 while in the embodiment of FIG. 8, it need not be composed of the same material.

In the latter case, moreover, weakened zones 70 may be provided in the region of the fins 68 so that the disk 66, at least in the embodiment of FIG. 8 where it need not be combustible, can be ruptured by the combustion or ignition of the charge and can be blown by the propellant gases out of the mouth of the barrel.

In the latter embodiment, therefore, the disk is a frangible disk which is expelled from the weapon by the propellant gases.

Figure 9:
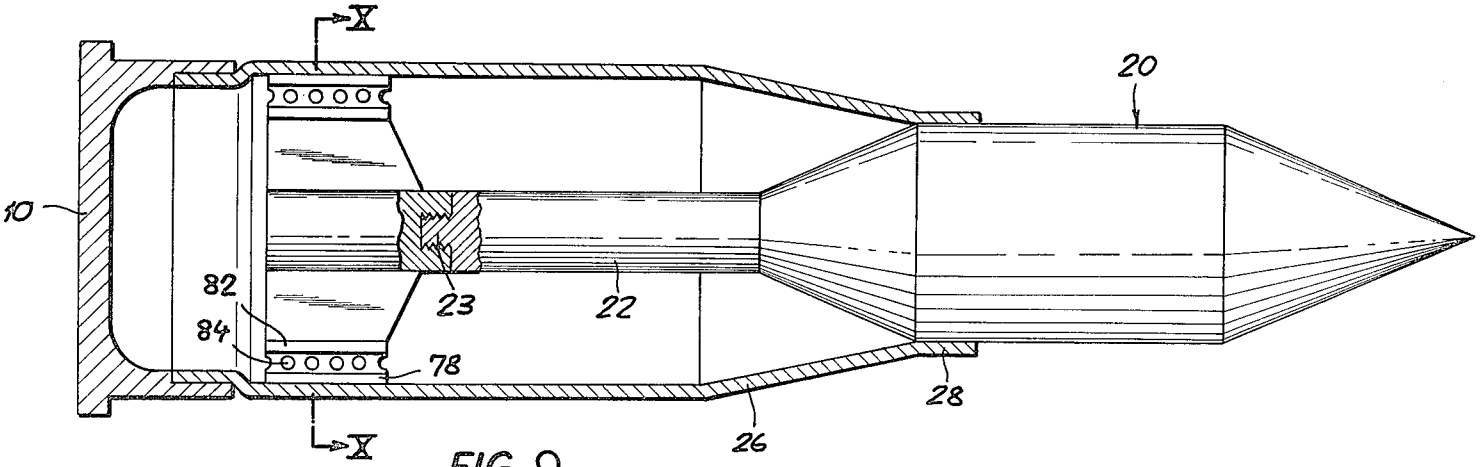
FIG. 9 is an axial cross-sectional view illustrating yet another embodiment of the invention.
Figure 10:
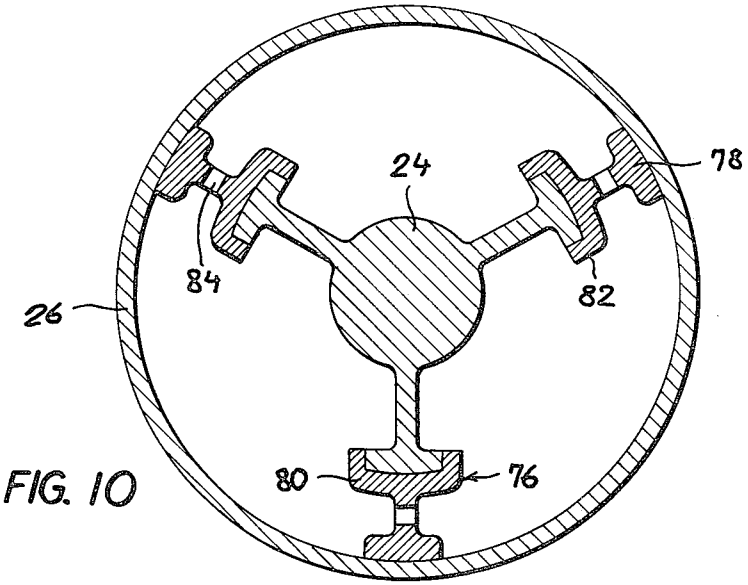
FIG. 10 is a cross-sectional view taken along the line X—X of FIG. 9.

In the embodiment illustrated in FIGS. 9 and 10, the support element is in the form of individual radially extending supports 76 of H-profile (FIG. 10) having an outer flange 78 bearing upon and curved to conform to the inner wall of the casing 26. A web of each support 76 lies in an axial plane of the cartridge and can be formed with perforations 84 to ensure proper distribution of the ignition of the charge. The openings 84 may, moreover, serve to weaken the supports to enable them to readily break apart or as lightening holes to reduce the overall weight of the system.

The innermost ends 80 of the support 76 have inwardly bent portions 82 flanking the tailfins and thereby forming recesses which extend in the axial direction and snugly receive the tailfins.

It is preferred to provide at least three angularly equispaced tailfins, each of which can be fitted with a respective support 76, so as to center the tailfin assembly and hence the projectile in the casing upon insertion of the projectile into the latter.

Figure 11:
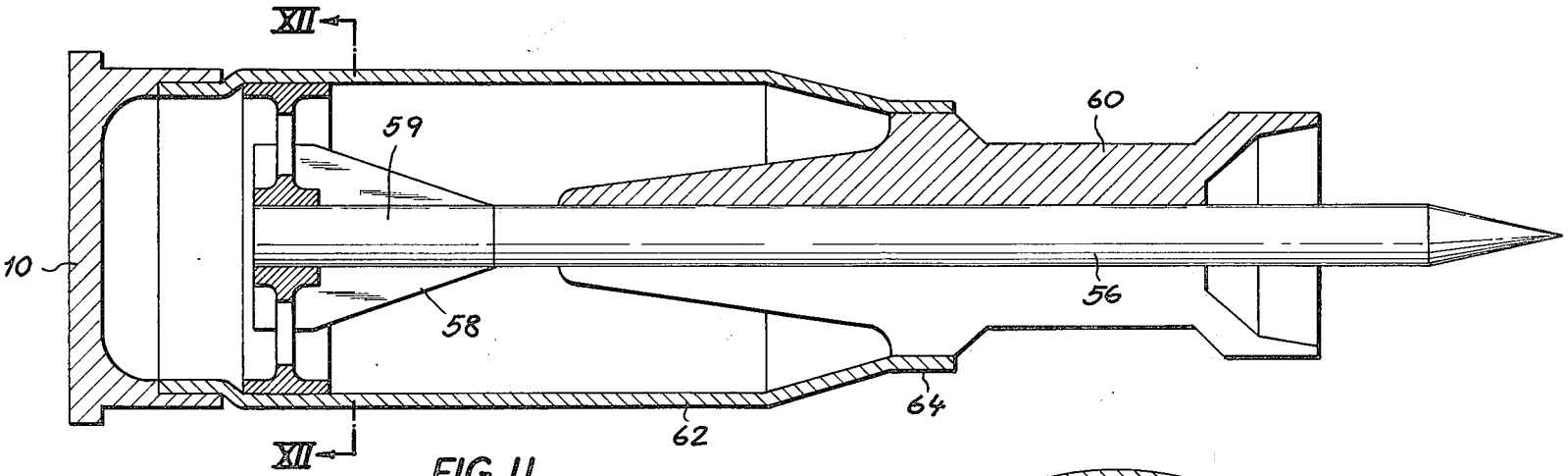
FIG. 11 is an axial cross-sectional view of a further embodiment of a cartridge-type munition round.
Figure 12:
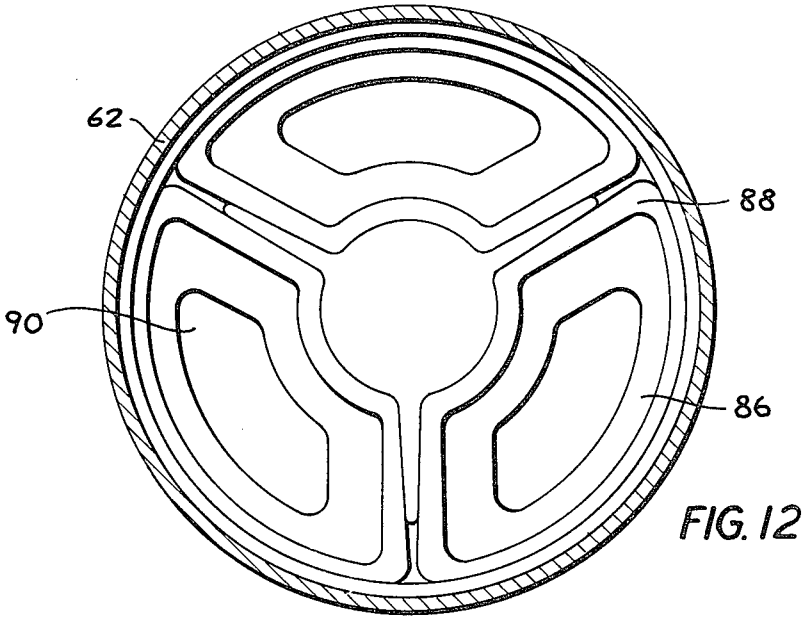
FIG. 12 is a cross-sectional view taken along the line XII—XII of FIG. 11.

In the embodiment of FIGS. 11 and 12, moreover, individual support elements are again provided in the form of individual segments 86 of H-profile. The segments 86 may clamp the tailfins 58 between them and can bear upon the carrier 59 as previously described. Outer flanges of the individual segments 86 can rest against the inner wall of the casing 62. The outer flanges are formed as part of continuous flanges 88 of the individual elements.

The supports 76 of FIG. 9 and the segment 86 of FIG. 11 can be composed of various materials, e.g. the combustible material of the casing 4 of metal or synthetic resin which need not be combustible. Openings 90 are provided in the segments to communicate between the chambers within the casing.

When the support members are noncombustible, it is advantageous to ensure that they will be driven out of the weapon and are composed of a material which will not cause scoring of the barrel.

The supports 76 are preferably constituted of compressed particulate or powdered material in accordance with an embodiment of the invention.

We claim:

1. A cartridge-type munition round for a barrel-type weapon, comprising:

a projectile having a projectile body and an extension projecting rearwardly from said body;

a casing receiving said extension whereby the bulk of the projectile projects from the casing and secured to said projectile, said casing being adapted to contain a firing charge for the projectile, said casing being composed at least in part of combustible material, said casing having a forwardly converging neck at a forward end of the casing engaging said projectile around said body at a first location; and a support element within said casing surrounding and engaging said extension at a location axially spaced from said neck, said support element extending at least in part radially inwardly from said casing to said extension, said support element having generally the configuration of a disk subdividing the interior of said casing into two charge-receiving chambers and formed with at least one opening communicating between said chambers, one of said charge-receiving chambers extending between said neck and said disk around said body, said support element being composed of the same combustible material as said casing.

2. The cartridge-type munition round defined in claim 1 wherein said projectile is a fin-stabilized projectile and said support element bears against an inner wall of said casing and against a tail-fin assembly of said projectile.

3. The cartridge-type munition round defined in claim 2 wherein said disk is a ring having a U cross section in an axial plane of the round, said ring having an outer flange resting against an inner wall of said casing and an inner flange resting upon outer ends of the fins of the tail-fin assembly.

4. The cartridge-type munition round defined in claim 3 wherein said inner flange has a radially inwardly extending portion axially abutting said assembly.

5. The cartridge-type munition round defined in claim 2 wherein said disk is formed with cutouts conforming to and accommodating the tail fins of said assembly.

6. The cartridge-type munition round defined in claim 1 wherein the disk is formed with a frustoconical portion converging forwardly and terminating in a cylindrical portion engaging said extension, said frustoconical portion having an outer cylindrical formation engaging the outer wall of said casing.

7. The cartridge-type munition round defined in claim 6 wherein said outer cylindrical formation is bonded in the casing.

8. The cartridge-type munition round defined in claim 6 wherein the outer cylindrical formation has the same diameter as the casing and is constituted as part thereof.

9. A cartridge-type munition round for a barrel-type weapon, comprising:

a projectile having a projectile body and an extension projecting rearwardly from said body;

a casing receiving said extension whereby the bulk of the projectile projects from the casing and secured to said projectile, said casing being adapted to contain a firing charge for the projectile, said casing being composed at least in part of combustible material, said casing having a forwardly converging neck at a forward end of the casing engaging said projectile around said body at a first location; and a support element within said casing surrounding and engaging said extension at a location axially spaced from said neck, said support element extending at least in part radially inwardly from said casing to said extension, said support element having generally the configuration of a disk subdividing the interior of said casing into two charge-receiving chambers and formed with at least one opening communicating between said chambers, one of said charge-receiving chambers extending between said neck and said disk around said body, said support element being composed at least in part of a compacted powder body.

10. The cartridge-type munition round defined in claim 9 wherein said projectile is a fin-stabilized projectile and said support element bears against an inner wall of said casing and against a tail-fin assembly of said projectile.

11. The cartridge-type munition round defined in claim 10 wherein said disk is a ring having a U cross section in an axial plane of the round, said ring having an outer flange resting against an inner wall of said casing and an inner flange resting upon outer ends of the fins of the tail-fin assembly.

12. The cartridge-type munition round defined in claim 11 wherein said inner flange has a radially inwardly extending portion axially abutting said assembly.

13. The cartridge-type munition round defined in claim 10 wherein said disk is formed with cutouts conforming to and accommodating the tail fins of said assembly.

14. The cartridge-type munition round defined in claim 9 wherein the disk is formed with a frustoconical portion converging forwardly and terminating in a cylindrical portion engaging said extension, said frustoconical portion having an outer cylindrical formation engaging the outer wall of said casing.

15. The cartridge-type munition round defined in claim 14 wherein said outer cylindrical formation is bonded in the casing.

16. The cartridge-type munition round defined in claim 14 wherein the outer cylindrical formation has the same diameter as the casing and is constituted as part thereof.

* * * * *